US005380592A

United States Patent [19]

Tung

[11] Patent Number: 5,380,592

[45] Date of Patent: Jan. 10, 1995

[54] TRILOBAL AND TETRALOBAL CROSS-SECTION FILAMENTS CONTAINING VOIDS

[75] Inventor: Wae-Hai Tung, Seaford, Del.

[73] Assignee: E. I. Du Pont de Nemours and Company, Wilmington, Del.

[21] Appl. No.: 174,523

[22] Filed: Dec. 28, 1993

[51] Int. Cl.[6] ..... D02G 3/00

[52] U.S. Cl. ..... 428/397; 428/398; 428/376

[58] Field of Search ..... 428/357, 364, 376, 398, 428/397

[56] References Cited

U.S. PATENT DOCUMENTS

| | | | |
|---|---|---|---|
| 3,745,061 | 7/1973 | Champaner et al. | 428/398 |
| 4,020,229 | 4/1977 | Cox, Jr. | 428/398 |
| 5,108,838 | 4/1992 | Tung | 428/357 |
| 5,190,821 | 3/1993 | Goodall et al. | 428/397 |
| 5,208,106 | 5/1993 | Tung | 428/397 |
| 5,230,957 | 7/1993 | Lin | 428/398 |
| 5,279,897 | 1/1994 | Goodall et al. | 428/398 |

FOREIGN PATENT DOCUMENTS

| | | | |
|---|---|---|---|
| 62-20608 | 9/1987 | Japan | 428/398 |

*Primary Examiner*—Newton Edwards

[57] ABSTRACT

This invention provides improved synthetic filaments having a trilobal or tetralobal cross-sectional shape with convex curves along the contour of each lobe, and wherein a continuous void extends axially through each lobe. The filaments are especially suitable for making carpets which exhibit low glitter and have high bulk and excellent soil hiding performance.

5 Claims, 5 Drawing Sheets

TRILOBAL AND TETRALOBAL CROSS-SECTION FILAMENTS CONTAINING VOIDS

BACKGROUND OF THE INVENTION

1. Field of the Invention

The present invention relates to improved synthetic filaments having a trilobal or tetralobal cross-sectional shape with convex curves along the contour of each lobe. At least one continuous void is located in each lobe of the filament. The filaments are especially suitable for making carpets which exhibit low glitter and have high bulk and excellent soil hiding performance.

2. Description of the Related Art

In Tung, U.S. Pat. Nos. 5,108,838, 5,176,926, and 5,208,106 synthetic filaments having various trilobal and tetralobal cross-sectional shapes are disclosed. These filaments are free of flat surfaces and have convex curves, connected by cusps, along the contour of each lobe. The filaments may be used to make carpet yams which, in turn, may be tufted into backing materials to produce carpets having low glitter and high bulk.

However, one disadvantage with such filaments and carpets is that they may exhibit poor "soiling performance". By the term "soiling performance", it is meant the apparent resistance of a fiber to visible soiling which may be independent of the soiling which actually occurs. Now, in accordance with the present invention, it has been found that the soiling performance of the above-described filaments may be improved by incorporating voids therein which extend continuously along the lengths of the filaments.

SUMMARY OF THE INVENTION

The present invention relates to improved synthetic filaments having distinctive trilobal and tetralobal cross-sections. The filaments are free of flat surfaces and have convex curves connected by cusps along the contour of the filament. These filaments are further characterized by having 2 to 20 curvature reversals along the contour of the filament's cross-section. At least one continuous void extends axially through each lobe of the filament. The axial core of the filament may also contain a continuous void, or the core may be solid.

Preferably, the void content of the filaments is about 4 to 20%. Suitable thermoplastic polymers include polyamides such as nylon 66 or nylon 6, polyesters, polyolefins, and polyacrylonitrile. Bulked continuous filament yarns or spun staple yams may be prepared from the filaments.

DETAILED DESCRIPTION OF THE INVENTION

The filaments of this invention are generally prepared by spinning molten polymer or polymer solutions through spinneret capillaries which are designed to provide the desired configuration of the voids and overall cross-section of the filaments.

The filaments may be prepared from synthetic, thermoplastic polymers which are melt-spinnable. These polymers include, for example, polyolefins such as polypropylene, polyamides such as polyhexamethylene adipamide (nylon 66), polycaprolactam (nylon 6), and polyesters such as polyethylene terephthalate. Copolymers, terpolymers, and melt blends of such polymers are also suitable. For instance, copolymers of hexamethylene-adipamide and hexamethylene-5-sulfoisophthalamide, as described in Anton et al., U.S. Pat. No. 5,108,684 may be used. Other suitable nylon copolymers and terpolymers may include units of diacids such as isophthalic acid and terephthalic acid, and units of diamines such as 2-methylpentamethylene diamine.

Generally, in the melt-spinning process, the molten polymer is extruded through a spinneret into air or other gas, or into a suitable liquid, where the polymer cools and solidifies to form filaments. Typically, the molten polymer is extruded into a quench chimney where chilled air is blown against the newly formed hot filaments. The filaments are pulled through the quench zone by means of a feed roll and then treated with a spin-draw finish from a finish applicator. The filaments are then passed over heated draw rolls. Subsequently, the filaments may be crimped and cut into short lengths to make staple fiber, or bulked to make bulked continuous filaments (BCF). Crimping of the yarn may be conducted by such techniques as gear-crimping or stuffer box crimping. For bulking the yarn, such hot air jet-bulking methods, as described in Breen and Lauterbach, U.S. Pat. No. 3,186,155, may be employed.

Polymers which form solutions, such as acrylonitrile, may also be used. These polymer solutions are dry-spun into filaments. In the dry-spinning process, the polymer solution is extruded as a continuous stream into a heated chamber to remove the solvent.

It is recognized that in the above-described spinning methods, the specific spinning conditions, e.g., viscosity, rate of extrusion, quenching, etc. will vary depending upon the polymer used. The polymer spinning dope may also contain conventional additives such as antioxidants, dyes, pigments, antistatic agents, ultraviolet (UV) stabilizers, etc.

Referring to FIGS. 3, 4, 5, and 6, examples of suitable spinneret capillaries for producing the filaments of this invention are illustrated.

Figure 3:
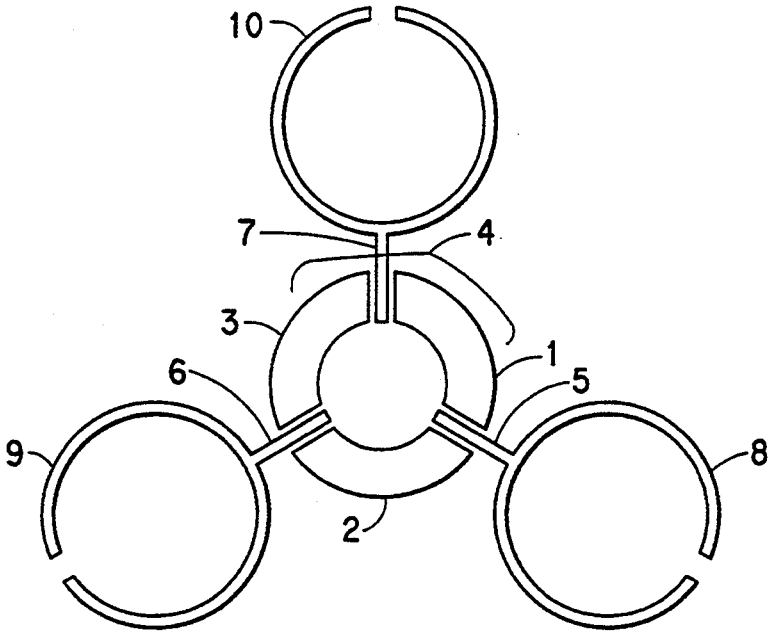
FIG. 3 is a face view of a spinneret capillary of the present invention having three central annular slots and three peripheral annular slots.

In FIG. 3, the capillary contains three central annular slots (1), (2), and (3) which are arranged to form a "central ring" (4). Extending from the central ring are three radial slots (5), (6), and (7) which connect the ring to three peripheral annular slots (8), (9), and (10). Molten polymer or polymer solutions may flow through the central and peripheral annular slots and radial slots to produce trilobal filaments in accordance with this invention.

Typically, the central annular slots, which are approximately equally-spaced apart, each have a width of about 0.002 to 0.005 inches. Likewise, the peripheral annular slots also have a width of about 0.002 to 0.005 inches and are approximately equally-spaced apart.

Figure 4:
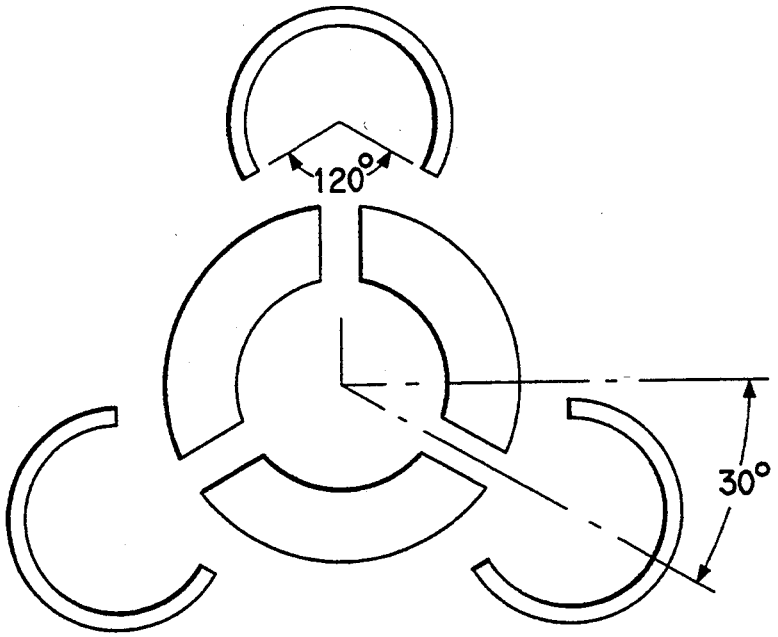
FIG. 4 is a face view of a spinneret capillary of the present invention having three central annular slots and three peripheral annular slots, wherein the peripheral and central slots are of different dimensions.
Figure 4A:
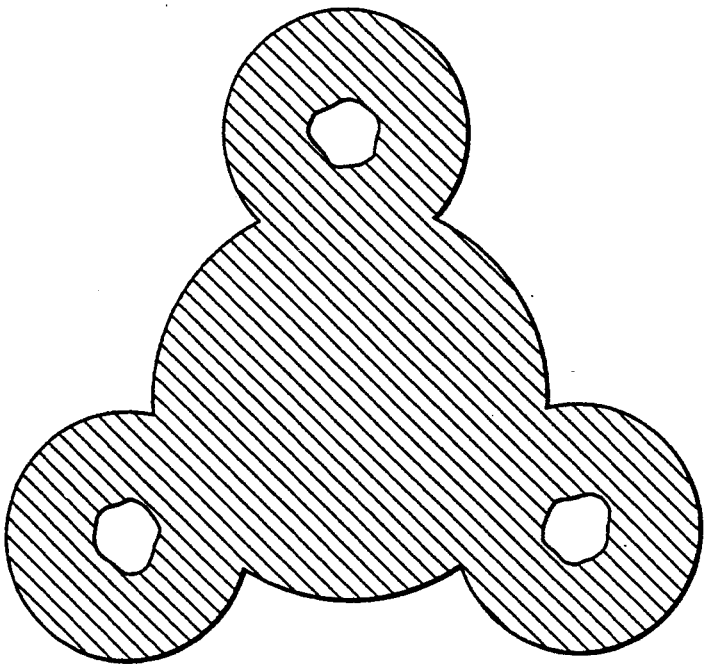
FIG. 4A is a cross-sectional view of a filament spun through a capillary of the type shown in FIG. 4.

It is understood that the above-described dimensions may vary depending upon the melt viscosity and surface tension of the specific polymer. Furthermore, while the peripheral slots typically have the same dimensions, it is not necessary that the central and peripheral slots be of the same size, as illustrated in FIG. 4. It is also not necessary that the capillary contain radial slots extending from the central ring. A capillary design without radial slots is shown in FIG. 4.

Figure 5:
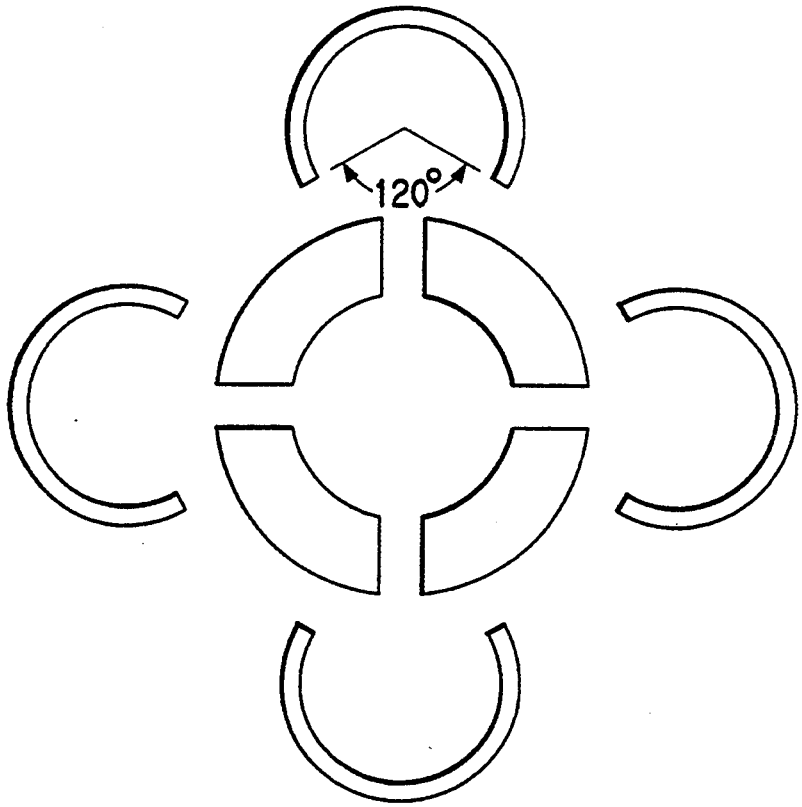
FIG. 5 is a face view of a spinneret capillary of the present invention having four central annular slots and four peripheral annular slots.
Figure 5A:
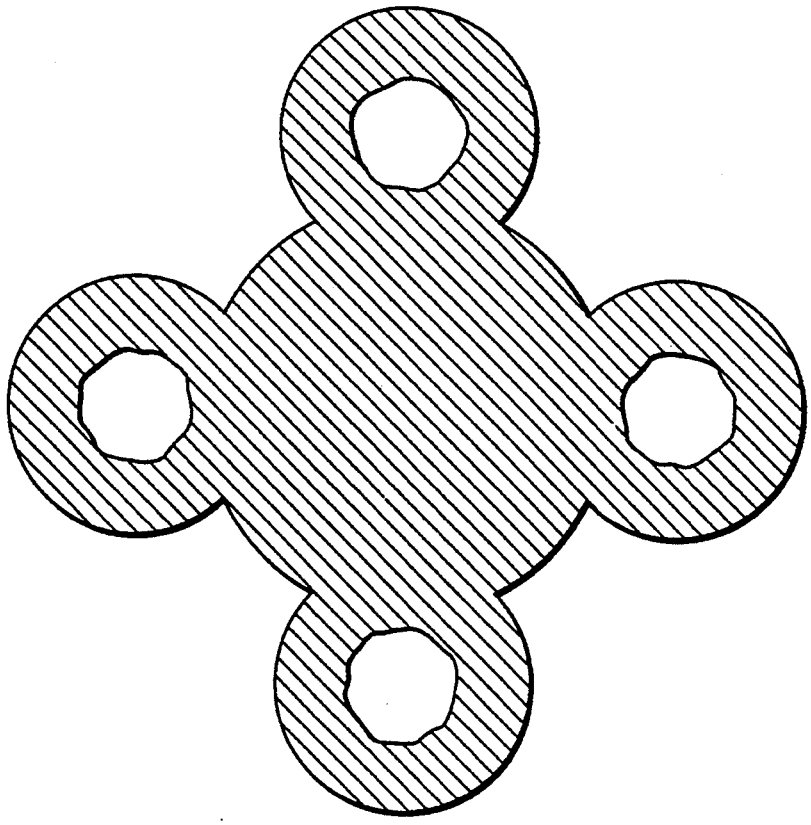
FIG. 5A is a cross-sectional view of a filament spun through a capillary of the type shown in FIG. 5 having voids in each of its lobes and a solid axial core.
Figure 6:
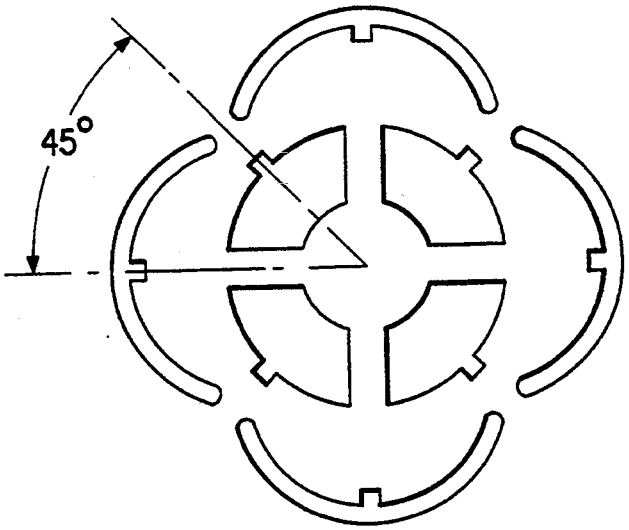
FIG. 6 is a face view of a spinneret capillary having four central annular slots and four peripheral annular slots.
Figure 6A:
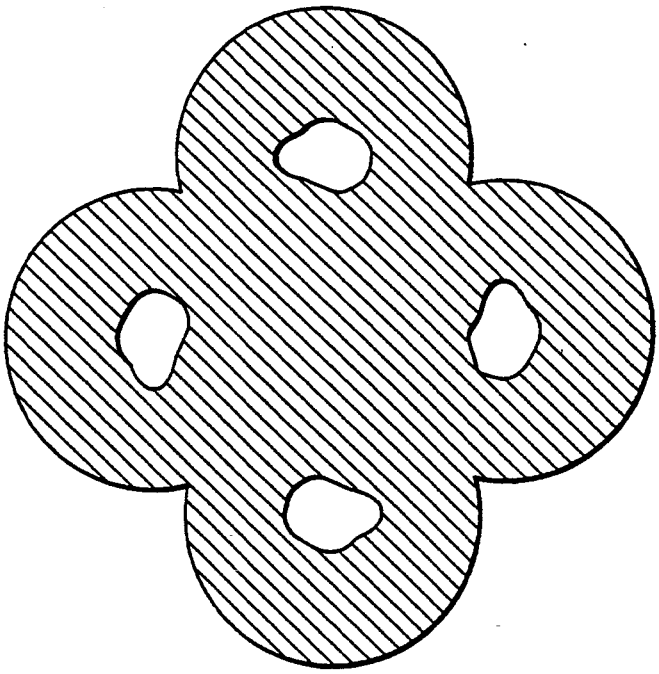
FIG. 6A is a cross-sectional view of a filament spun through a capillary of the type shown in FIG. 6.

In still other embodiments, as shown in FIGS. 5 and 6, the capillary has four, rather than three, peripheral annular slots. These type of capillaries may be used to prepare tetralobal filaments in accordance with this invention. Examples of such tetralobal cross-sections are illustrated in FIGS. 5A and 6A.

The central and peripheral slots may be arranged in such a manner to form corresponding near-round voids in the filaments as shown in FIGS. 3A, 4A, 5A, and 6A. Alternatively, the central and peripheral slots may be arranged in different patterns to form, e.g., square, pentagonal, or hexagonal, shaped voids in the filaments.

The filaments of this invention have a void content (percent of the filament's cross-section which is hollow) of about 4 to 20% . This void content may be adjusted by adjusting the quenching rate and/or the polymer melt viscosity. Generally, the void content increases as the quenching rate or the melt viscosity increases.

Figure 3A:
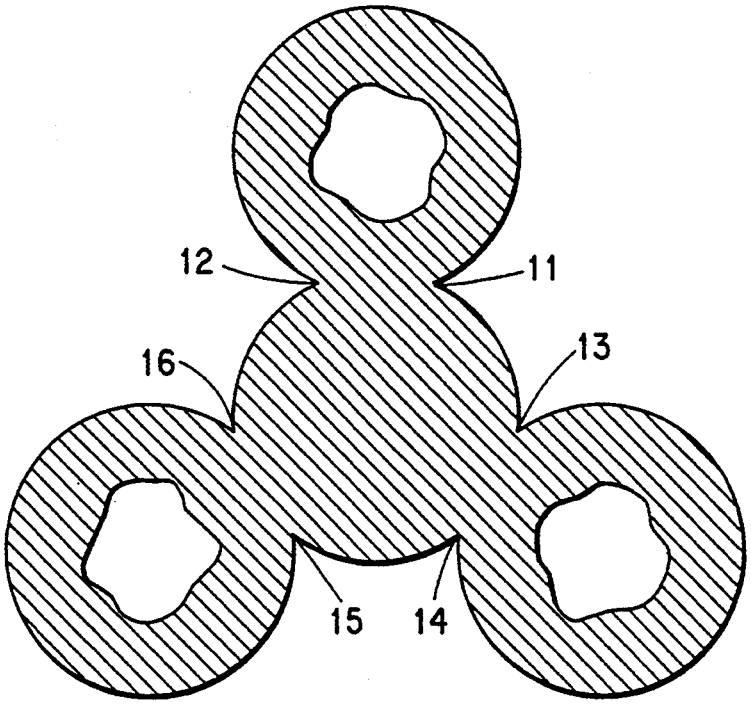
FIG. 3A is a cross-sectional view of a filament spun through a capillary of the type shown in FIG. 3 having voids in each of its lobes and a solid axial core.

It is critical that the filaments of this invention have a cross-section of the type described in the aforementioned Tung, U.S. Pat. No. 5,108,838, the disclosure of which is hereby incorporated by reference. Particularly, the filaments have a trilobal or tetralobal cross-section which is essentially free of flat surfaces. The filaments have convex curves, connected by cusps, along the contour of the filament. These cusps are considered "curvature reversal points". By the term "curvature reversal points", it is meant the fixed points along the contour of the filament, where a point tracing the curve along the filament's contour would reverse its point of direction. Referring to FIG. 3A, these curvature reversals are identified as cusps (11), (12), (13), (14), (15), and (16). It is believed that this unique filament structure allows carpets containing such filaments to exhibit low glitter and have high bulk.

The key improvement of this invention is that the filaments contain voids which extend continuously along the length of the filaments. At least one continuous void is located in each lobe of the filament. Preferably, the axial core also contains a void, but filaments having solid axial cores may also be prepared. It is believed that the presence of such voids allows for improved soiling performance.

The filaments are generally uniform in cross-section along their length and may be used for several different applications, including carpets, textile, or non-woven uses. For carpet applications, the filaments may be uncrimped, or crimped in order to provide additional bulk to the carpet yarn. The carpet yam containing such filaments may be in the form of bulked continuous filament (BCF) yam or staple fiber yarn. It is also recognized that the filaments may be blended with each other or with other filaments to form filament blends. For carpet yarn, the denier per filament (dpf) will preferably be in the range of 6 to 25, while the total yarn denier will be at least about 500.

The carpet yarns are then tufted into a carpet backing material by techniques known in the art. The yarn may be inserted as loops to form loop-pile carpets. For cut-pile carpets, the loops may be cut to form parallel vertical tufts which are then evenly sheared to a desired height. The carpets made from the yarns, of this invention are essentially tree of glitter, have high bulk, and have excellent soiling performance.

The following examples further illustrate the invention but should not be construed as limiting the scope of the invention.

TESTING METHODS

Carpet Glitter and Bulk Rating

The degrees of bulk and glitter for different carpet samples were visually compared in a side-by-side comparison without knowledge of which carpets were made with which yarns. The carpets were examined by a panel of people familiar with carpet construction and surface texture. A carpet sample composed of round cross-section fiber was chosen as the control. The remaining samples were given a subjective rating of either low, medium, or high for both bulk and glitter.

Relative Viscosity

The relative viscosity (RV) of nylon 66 was measured by dissolving 5.5 grams of nylon 66 polymer in 50 cc of formic acid. The RV is the ratio of the nylon 66/formic acid solution to the absolute viscosity of the formic acid. Both absolute viscosities were measured at 25° C.

Soiling Performance

Carpet test samples were cut into a size of 8 inches ×8 inches. Three test samples were taped together with duct tape to form a carpet piece that was 8 inches wide and 24 inches long. The taped carpets were fitted into an 8 inch deep canister with a 24 inch internal circumference and held in place with two hoops of stiff wires. Dirty beads were prepared by adding 30 g of standard soiling dirt, available from 3M, to one liter of Surlyn beads and mixing for 5 minutes on a ball mill. 250 ml of dirty beads and 250 ml of ½ inch ball bearings were added to the canister which was then sealed. The test samples were removed from the canister, vacuumed to remove loose dirt and rated to determine relative soiling performance. Carpet samples exhibiting poor soiling performance were given a soiling rating of high, i.e., the carpets had highly visible soiling. Carpet samples exhibiting good soiling performance were given a soiling rating of low, i.e., the carpets had low visible soiling.

Percent Void Determination

The percent void of the filament's cross-section (void content) may be measured using a DuPont Shape Analyzer, Model VSA-1, which measures the area of the voids and the area of the filament's entire cross-section. The DuPont Shape Analyzer characterizes textile fiber yarn cross-sections by performing numerical analysis on the digital contour of individual filament cross-sections. A simple calculation of dividing the void area by the cross-section area provides the void of the filament's cross-section.

EXAMPLES

In the following Examples, nylon 66 filaments having various cross-sections were produced. The nylon 66 filaments were spun from different spinnerets with capillary designs, similar to those shown in FIGS. 1–4. The nylon 66 polymer used for all of the examples had a relative viscosity (RV) of 78±3 units. The polymer temperature before the spinning pack was controlled at about 290°±1° C., and the spinning throughput was 70 pounds per hour. The polymer spin dope did not contain any delustrants. The polymer was extruded through the different spinnerets and divided into two equal size filament segments. The molten fibers were then rapidly quenched in a chimney, where cooling air at 9° C. was blown past the filaments at 300 cubic ft./rain (0.236 cubic m/sec). The filaments were pulled by a feed roll rotating at a surface speed of 800 yd./min (732 m/min) through the quench zone and then were coated with a lubricant for drawing and crimping. The coated yarns were drawn at 2197 yds./min (2.75× draw ratio) using a pair of heated (210° C.) draw rolls. The yarns were then forwarded into a dual impingement bulking jet (230° C. hot air), similar to that described in Coon, U.S. Pat. No. 3,525,134, to form two 1200 denier, 15 denier per filament (dpf) yarns.

The spun, drawn, and crimped bulked continuous filament (BCF) yams were cable-twisted to 2.5 turns per inch (tpi) on a cable twister and were then tufted into 22 oz./sq. yd., ¼ inch pile height carpets on a ⅛ inch gauge loop pile tufting machine. The tufted carpets were dyed in a beck dyer to form medium yellow and avocado colored carpets. The yellow colored carpets were used for soiling tests and the avocado colored carpets were used for glitter and bulk assessment. The carpet aesthetics were assessed by a panel of people familiar with carpet construction and surface texture, and the results are reported below in Table I.

TABLE I

Figure 1:
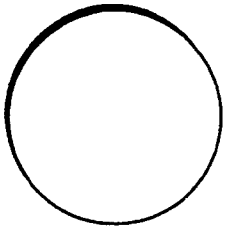
FIG. 1 (PRIOR ART)
FIG. 1 is a face view of a round spinneret capillary of the prior art.
Figure 1A:
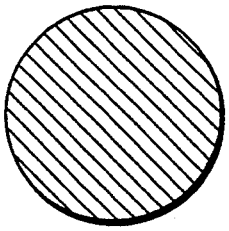
FIG. 1A (PRIOR ART)
FIG. 1A is a cross-sectional view of a filament spun through a capillary of the type shown in FIG. 1.
Figure 2:
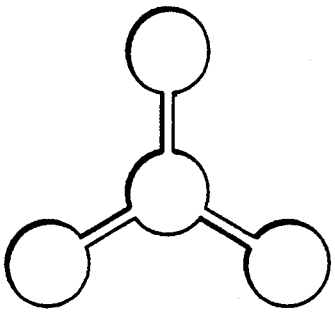
FIG. 2 (PRIOR ART)
FIG. 2 is a face view of a trilobal spinneret capillary of the prior art.
Figure 2A:
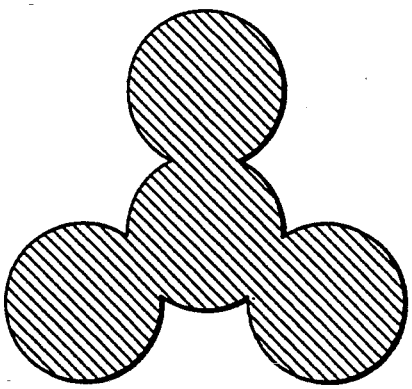
FIG. 2A (PRIOR ART)
FIG. 2A is a cross-sectional view of a filament spun through a capillary of the type shown in FIG. 2.

| Example | Cross-section | Glitter | Bulk | Soiling |
|---|---|---|---|---|
| 1 (Comparative) | round, FIG. 1A | Low | Low | High |
| 2 (Comparative) | solid trilobal with convex curves, FIG. 2A | None | Medium | High |
| 3 | 4 void trilobal with convex curves, (void in axial core) | None | High | Low |
| 4 | 4 void trilobal with convex curves, (void in axial core) | None | High | Low |

Example 1 (Comparative)

As shown in FIG. 1A, filaments having a round cross-section with no voids were prepared. The filaments were spun through a spinneret capillary, as shown in FIG. 1, having a round orifice of 0.010 inches in diameter.

Example 2 (Comparative)

As shown in FIG. 2A, filaments having a trilobal cross-section with convex curves and having no voids in its lobes or axial core were prepared. The filaments were spun through a spinneret capillary, as shown in FIG. 2, having the following dimensions.

The central orifice had a diameter of 0.0150 inches, and the radial slots had widths of 0.0025 inches. The peripheral orifices had diameters of 0.0150 inches. The distance from the central orifice to the center of the peripheral orifices was 0.0285 inches.

Example 3

Filaments having a trilobal cross-section with convex curves and having voids in each of its lobes and a void in its axial core were prepared. The filaments were spun through a spinneret capillary, having the following dimensions.

The three central annular slots each had a width of 0.0024 inches and were spaced 0.0100 inches apart to form a "central ring". The radius of the central ring was 0.0300 inches. The three radial slots extending from the central ring each had a width of 0.0020 inches. The three peripheral annular slots surrounding the central ring each had a width of 0.0024 inches. The three "peripheral rings" formed by these peripheral annular slots each had a radius of 0.0300 inches. The capillary depth was 0.015 inches.

Example 4

Filaments having a trilobal cross-section with convex curves and having voids in each of its lobes and a void in its axial core were prepared. The filaments were spun through a spinneret capillary, having the following dimensions.

The three central annular slots each had a width of 0.0040 inches and were spaced 0.008 inches apart to form a central ring. The radius of the central ring was 0.0400 inches. The three peripheral annular slots surrounding the central ring each had a width of 0.0030 inches. The three peripheral rings formed by these peripheral annular slots each had a radius of 0.0200 inches. The capillary depth was 0.015 inches.

What is claimed is:

1. A filament comprising a thermoplastic synthetic polymer, having a trilobal cross-section with a solid axial core, and having convex curves connected by cusps along its contour, said filament being free of flat surfaces and having 2 to 20 curvature reversals along its contour with a modification ratio of about 1.2 to 4.5, wherein the improvement comprises at least one continuous void extending axially in each lobe.

2. A filament comprising a thermoplastic synthetic polymer, having a tetralobal cross-section with a solid axial core, and having convex curves connected by cusps along its contour, said filament being free of flat surfaces and having 2 to 20 curvature reversals along its contour with a modification ratio of about 1.2 to 4.5, wherein the improvement comprises at least one continuous void extending axially in each lobe.

3. The filament of claim 1 or 2, wherein the void content is about 4 to 20%.

4. The filament of claim 1 or 2, wherein the synthetic thermoplastic polymer is selected from the group consisting of polyamides, polyesters, polyolefins, and polyacrylonitrile.

5. The filament of claim 4, wherein the polyamide is nylon 66.

* * * * *